US006475968B1

(12) United States Patent
Murphy et al.

(10) Patent No.: US 6,475,968 B1
(45) Date of Patent: Nov. 5, 2002

(54) CARBOHYDRATE CONTAINING CLEANING SURFACTANT AND METHOD FOR USING THE SAME

(75) Inventors: Dennis Stephen Murphy, Wyckoff, NJ (US); David Alan Binder, Saddle Brook, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/066,265

(22) Filed: Jan. 31, 2002

Related U.S. Application Data

(63) Continuation of application No. 09/864,948, filed on May 24, 2001, now Pat. No. 6,369,014.

(51) Int. Cl.[7] ..... C11D 3/22; C11D 3/43

(52) U.S. Cl. ..... 510/285; 510/470; 8/142; 8/158; 8/159; 8/149.1; 8/149.2

(58) Field of Search ..... 510/285, 470; 8/142, 158, 159, 149.1, 149.2

(56) References Cited

U.S. PATENT DOCUMENTS 6,051,421 A * 4/2000 Sauer et al. ..... 435/283.1
6,258,766 B1 * 7/2001 Romack et al. ..... 510/291

* cited by examiner

*Primary Examiner*—Charles Boyer
(74) *Attorney, Agent, or Firm*—Ronald A. Koatz

(57) ABSTRACT

This invention is directed to a surfactant comprising a carbohydrate group that results in superior cleaning in a dry cleaning system. The surfactant has a hydrocarbon group that is more solvent-philic than a carbohydrate group, and can result in reverse micelle formation in a densified gas like densified carbon dioxide.

18 Claims, No Drawings

CARBOHYDRATE CONTAINING CLEANING SURFACTANT AND METHOD FOR USING THE SAME

This is a continuation of Ser. No. 09/864,948 filed May 24, 2001 U.S. Pat. No. 6,369,014.

FIELD OF THE INVENTION

This invention is directed to a surfactant comprising a carbohydrate group. More particularly, the invention is directed to a surfactant comprising a carbohydrate group that results in superior cleaning properties in a dry cleaning system.

BACKGROUND OF THE INVENTION

In many cleaning applications, it is desirable to remove contaminants (e.g., stains) from substrates, like metal, ceramic, polymeric, composite, glass and textile comprising substrates. Particularly, it is highly desirable to remove contaminants from clothing whereby such contaminants include dirt, salts, food stains, oils, greases and the like.

Typically, dry-cleaning systems use organic solvents, like chlorofluorocarbons, perchloroethylene and branched hydrocarbons to remove contaminants from substrates. In response to environmental concerns, other dry-cleaning systems have been developed that use inorganic solvents, such as densified carbon dioxide, to remove contaminants from substrates. The systems that use carbon dioxide to remove contaminants from substrates generally employ a surfactant and a polar co-solvent so that a reverse micelle may be formed to trap the contaminant targeted for removal.

In view of the environmental concerns associated with dry cleaning in, for example, halogenated hydrocarbons, many cleaning establishments have expressed their interests in cleaning with continuous phase solvents that comprise densified gases such as densified carbon dioxide as well as a biodegradable functionalized hydrocarbon or a silicon comprising solvent. Unfortunately, however, cleaning with such solvents is not made easy because only very few surfactants are compatible with such continuous phases.

It is of increasing interest to develop surfactants that enhance cleaning in a system that uses a densified gas, functionalized biodegradable hydrocarbon and/or a silicon comprising solvent. This invention, therefore, is directed to a surfactant comprising a carbohydrate group that unexpectedly results in superior cleaning properties in a dry cleaning system that utilizes a densified gas, a functionalized biodegradable hydrocarbon and/or silicon comprising solvent.

Additional Information

Efforts have been disclosed for dry cleaning with carbon dioxide. In U.S. Pat. No. 5,676,705, a superior dry cleaning method which employs densified carbon dioxide is described.

Other efforts have been disclosed for dry cleaning with carbon dioxide. In U.S. Pat. No. 5,683,473, a superior method for dry: cleaning fabrics with a surfactant having a polysiloxane, branched polyalkylene oxide or halocarbon group is described.

Still further, U.S. Pat. No. 5,683,977 discloses a superior dry cleaning system with carbon dioxide and a surfactant adjunct.

Finally, in U.S. Pat. No. 5,866,005, a cleaning process using carbon dioxide as a solvent along with molecularly engineered surfactants is described.

None of the references above describe the use of surfactant comprising a carbohydrate group and a hydrocarbon group wherein the hydrocarbon group is more soluble in the dry cleaning solvent than the carbohydrate group.

SUMMARY OF THE INVENTION

In a first embodiment, the present invention is directed to a dry cleaning system comprising a surfactant comprising a hydrocarbon group which is solvent-philic and a carbohydrate group which is less solvent-philic than the hydrocarbon group.

In a second embodiment, the present invention is directed to a dry cleaning system comprising a dry cleaning solvent, and a surfactant or mixture of surfactants having the formula:

AXB I wherein (i) A is a moiety which is more soluble in the dry cleaning solvent than B;

(ii) X is

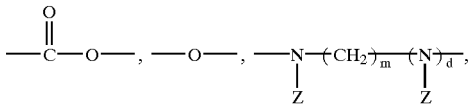

a divalent group comprising P or

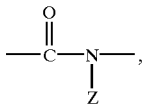

(iii) B is a carbohydrate group, (iv) Z is H, or a $C_{1-10}$ alkyl group, or

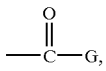

and G is a $C_{1-6}$ alkyl (v) m is an integer from 0 to about 10, and d is 0 when m is 0 and 1 when m is $\geqq 1$, with the proviso that A is not a siloxane, a halocarbon or a polyalkylene oxide.

In a third embodiment, the present invention is directed to a method for dry cleaning using the dry cleaning system of the first or second embodiment of the present invention.

Carbohydrate group, as used herein, is defined to mean a carbohydrate having at least one bond to an ester, ether, amine group, amide group, or divalent group comprising P. A divalent group comprising P is meant to mean a group derived from phosphine or phosphate.

DETAILED DESCRIPTION OF THE PREFERRED EMBODIMENTS

There generally is no limitation with respect to the surfactant used in this invention as long as the surfactant will enhance cleaning in a system which utilizes a continuous phase solvent comprising a densified gas, biodegradable functionalized hydrocarbon, a silicon comprising solvent, or a mixture thereof.

Often, however, the surfactants which may be used in this invention have A as a $C_3$ to $C_{15}$ alkyl group (preferably a $C_8$ to $C_{10}$ alkyl group), or an aryl group; B as a monosaccharide or disaccharide, and preferably, not a polysaccharide. In the structure, X is an ester, ether, or amine group, and preferably, an ester group.

Regarding the carbohydrate group, the only limitation with respect to the carbohydrate group is that the carbohydrate group is less soluble in the dry cleaning solvent than A. Such a carbohydrate group may be selected from the group consisting of glucose, fructose, sucrose, galactose, lactose, ribose, lyxose, allose, altrose, erythrose, talose and mannose, including derivatives and disaccharides prepared therefrom.

When preparing the surfactant described in the present invention, conventional reactions, like those involving carboxylic acids and alcohol groups (esterifications); alkyl halides and alkoxides (Williamson ether synthesis); and reduction reactions involving ketones and primary amines (amine synthesis), may be used to produce the desired surfactant.

It is also noted herein that the surfactants which may be used in this invention are not limited with respect to where the moiety represented by A is bonded, via the group represented by X, to the carbohydrate group. Therefore, the moiety represented by A may be bonded (via the group represented by X) to a carbon within the carbohydrate ring or a group pendant to the carbons which make up the carbohydrate ring Moreover, the surfactant employable in the present invention can include those which display carbohydrate ring opening after the moiety represented by A is attached to the carbohydrate ring by the group represented by X. Such a surfactant may also include a dimeric or trimeric surfactant generated from AXB monomers. A preferred dimeric surfactant is 1,4-bis-[6-O-(n-octyl-2,3,4-tri-O-benzyl-alpha-D-glucopyranosid)]succinate. It is also noted herein that microorganisms may be the source of the surfactants represented by AXB. Thus, surfactants which are classified as biosurfactants or microbial surfactants may be used in the dry cleaning system of the present invention.

A more detailed description of the types of surfactants comprising a carbohydrate group which may be used in this invention may be found in *Colloids and Surfaces A: Physicochemical and Engineering Aspects,* 102 (1995) 91–97, entitled "Non-ionic Sugar-Based Surfactants: Self Assembly and Air/Water Interfacial Activity" by Soderberg et al.; *Langmuir* 1997, 13, 6857–6860, entitled "Nonionic Boloamphiphiles and Gemini Surfactants Based on Carbohydrates" by Pestman et al.; *Langmuir* 1999, 15, 2009–2014, entitled "Thermodynamics of Micellization of Nonionic Saccharide-Based N-Acyl-N-Alkylaldosylamine and N-Acyl-N-Alkylamino-1-deoxyalditol Surfactants" by Pestman et al.; *Langmuir* 2001, 17, 1941–1949, entitled "Studies of N-Docecyllacto-bionamide, Maltose 6'-O-Dodecanoate, and Octyl-P-glucoside with Surface Tension, Surface Force, and Wetting Techniques" by Kjellin et al.; *Biosurfactants and Biotechnology*, pages 21–41, (1987) by Marcel Dekker, Inc., and *Tetrahedron* 55 (1999) 12711–12722, entitled "New Dimeric Surfactants from Alkyl Glucosides" by Castro et al., the disclosures of which are all incorporated herein by reference. Additional surfactants which may be used in this invention are described in World Patent Application Nos. 95/19951; 95/19953; 95/19954; 95/20026, the disclosures of which are incorporated herein by reference.

In a preferred embodiment, the sulfactant comprising a carbohydrate group which may be employed in this ;invention has an HLB of less than 13; and preferably, less than about 12; and most preferably, less than about 10. In a most preferred embodiment, the surfactant comprising a carbohydrate group which may be used in this invention is an alkyl glucoside with A as a $C_{8-10}$ alkyl group, B as a glucose group and X as an ester group, wherein A is joined to B via X and not at a carbon which is part of the glucose ring. Such a most preferred surfactant is sold under the name Triton CG-110 and made commercially available by the Union Carbide Corporation.

There generally is no limitation with respect to the continuous phase solvent (i.e., fluid) which may be employed with the surfactants described herein other than that the solvent is a densified gas (e.g., fluid which is a gas at standard temperature and pressure), a biodegradable hydrocarbon or a silicon comprising solvent, and capable of being a continuous phase in a dry cleaning application. Illustrative examples of the types of solvents which may be employed in this invention include a $C_2$–$C_4$ substituted or unsubstituted alkane, carbon dioxide, silicone oil, and an azeotropic solvent.

Regarding the solvent which is a densified gas, such a solvent may be, within the dry cleaning composition or process, a gas, liquid or supercritical fluid depending upon how densified the solvent is (how much pressure is applied at a given temperature) in the domestic or commercial cleaning application the solvent is used in. Propane and carbon dioxide tend to be the preferred solvents when the solvent selected is one which is a densified gas. Carbon dioxide, however, is especially preferred.

As to the silicon comprising solvent which may be used in this invention, such a solvent is typically a commercially available cyclic-siloxane based solvent made available from GreenEarth Cleaning, LLC. Such a solvent is generally one which has a flash point over about 65° C., with octamethylcyclotetrasiloxane and decamethyl-cyclopentasiloxane being most preferred. A more detailed description of such conventional siloxane comprising solvents may be found in U.S. Pat. No. 5,942,007, the disclosure of which is incorporated herein by reference.

Especially preferred silicon comprising solvents are those having the formula:

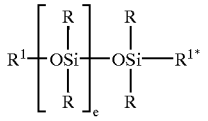

II wherein each R is independently a substituted or unsubstituted linear, branched or cyclic $C_{1-10}$ alkyl, $C_{1-10}$ alkoxy, substituted or unsubstituted aryl, aryloxy, trihaloalkyl, cyanoalkyl or vinyl group, and $R^1$ is a hydrogen or a siloxyl group having the formula:

$$Si(R^2)_3 \qquad \text{III}$$

and each $R^2$ is independently a linear, branched or cyclic $C_{1-10}$ substituted or unsubstituted alkyl, $C_{1-10}$ alkoxy, substituted or unsubstituted aryl, trihaloalkyl, cyanoalkyl, vinyl group, amino, amido, ureido or oximo group, and $R^1$ is an unsubstituted or substituted linear, branched or cyclic $C_{1-10}$ alkyl or hydroxy, or $OSi(R^2)_3$ whereby $R^2$ is as previously defined, and e is an integer from about 0 to about 20.

The most preferred linear siloxane solvent is one wherein each R is methyl, $R^1$ is $Si(R^2)_3$, $R^2$ is methyl and $R^1$ is methyl. Preferably, e is an integer from about 0 to about 10, and most preferably, an integer from about 2 to about 5.

Such solvents are made commercially available by General Electric, and Dow Corning under the name Dow Corning 200(R) fluid. A description of the solvents may be found in U.S. Pat. Nos. 3,931,047 and 5,410,007, the disclosures of which are incorporated herein by reference.

The biodegradable functionalized hydrocarbon that may be used in this invention includes those generally classified as all azeotropic solvent. Such an azeotropic solvent often comprises alkylene glycol alkyl ethers, like propylene glycol tertiary-butyl ether, and is described in U.S. Pat. No. 5,888,250, the disclosure of which is incorporated herein by reference. Moreover, as used herein, biodegradable functionalized hydrocarbon is defined to mean a biodegradable hydrocarbon comprising at least one member selected from the group consisting of an aldehyde, ketone, alcohol, alkoxy, ester, ether, amine, amide and sulfur comprising group.

When dry cleaning, for example, fabrics, like clothing or garments, with a solvent that is a densified gas (and the surfactants of this invention), the machine which is employed for cleaning is well known in the art. Such a machine typically comprises a gas supply, cleaning tank and condenser. The machine may further comprise a means for agitation. The means for agitation may be, for example, a mechanical device like a mechanical tumbler, or a gas-jet agitator. The art recognized machines which may be used in this invention (e.g., when a densified gas is used) may be found in U.S. Pat. Nos. 6,012,307, 5,943,721, 5,925,192, 5,904,737, 5,412,958, 5,267,455 and 4,012,194, the disclosures of which are incorporated herein by reference. Other machines employable in the present invention are made commercially available by Alliance Laundry Systems.

When dry cleaning for example, fabrics, like clothing or garments, with the biodegradable functionalized hydrocarbons or silicon comprising solvents and the surfactants described in this invention, the type of machine that may be used for the dry cleaning process is the same or substantially the same as the commonly used dry cleaning machines used for dry cleaning with perchloroethylene. Such machines typically. comprise a solvent tank or feed, a cleaning tank, distillation tanks,.a filter and solvent exit. These commonly:used machines are described,.for example, in U.S. Pat. No. 4,712,392, the disclosure of which is incorporated herein by reference.

When the fabric is placed in the machine and the continuous phase solvent of choice is fed into the machine, the normal cleaning cycle is run (typically between ten (10) minutes and one (1) hour). Prior to or after the start of the cleaning cycle, the surfactant comprising a carbohydrate group of this invention is introduced into the cleaning machine. Any of the surfactant represented by formula AXB may be used, including any mixture of surfactants thereof as well as dimeric or trimeric products thereof. Often, the amount of surfactant employed is from about 0.001 to about 15.0%, and preferably, from about 0.01 to about 5.0%, and most preferably, from about 0.01 to about 3.0% by weight of surfactant, based on total weight of surfactant and continuous phase solvent, including all ranges subsumed therein.

In addition to continuous phase solvent and the surfactant described in this invention, it is especially preferred to add from about 0.01% to about 10.0%, and preferably, from about 0.03 to about 3.0%, and; most preferably, from about 0.05 to about 0.3% by weight of a polar additive (e.g., $C_{1-10}$ alcohol and preferably water) based on total weight of continuous phase solvent, surfactant and polar additive, including all ranges subsumed therein. The addition of polar additive to the continuous phase solvent and surfactant is often desired so that cleaning may be enhanced, for example, by the formation of reverse micelles.

When cleaning fabrics, for example, with the surfactants of this invention, the pressure and temperature of the dry cleaning system (e.g., the system comprising the fabric targeted for cleaning, the continuous phase solvent and the surfactant described in this invention) within the machine is limited only to the extent that the temperature and pressure allow for the fabric to be cleaned. The pressure is often from about 14.7 to about 10,000 psi, and preferably, from about 200 to about 5,000 psi, and most preferably, from about 250 to about 3,000 psi, including all ranges subsumed therein. The temperature is often from about −30.0 to about 100° C., and preferably, from about −5.0 to about 70.0° C., and most preferably, from about 0.0 to about 45° C., including all ranges subsumed therein.

It is also noted herein that optional additives may be employed when cleaning with the surfactants described in this invention. Such optional additives include an oxidizing agent, like hydrogen peroxide, and an organic bleach activator such as those represented by the formula:

IV

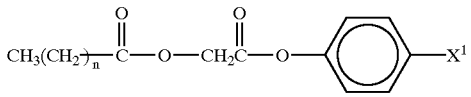

wherein n is an integer from about 0 to about 20 and $X^1$ is hydrogen or $SO_3M$ and M is hydrogen, an alkaline metal or an immodium cation. A more detailed description of such additives may be found in U.S. Pat. No. 5,431,843, the disclosure of which is incorporated herein by reference.

Other optional additives that may be employed to clear with the surfactants described in this invention include anti-static agents and deodorizing agents. Such anti-static agents typically include $C_8$–$C_{12}$ alcohol ethoxylates, $C_8$–$C_{12}$ alkaline glycols and glycol esters. The deodorizing agent, on the other hand, typically includes fragrances such as those described in U.S. Pat. No. 5,784,905, the disclosure of which is incorporated herein by reference.

Still other optional additives include viscosity modifiers like propylene glycol and sodium xylene sulphonate. As to the amount of optional additives used with the surfactants of the present invention, such an amount is limited only to the extent that the additive does not interfere with the cleaning process.

The examples below are provided for illustrative purposes, and they are not intended to restrict the scope of the invention. Thus, various changes may be made to the specific embodiments of this invention without departing from its spirit. Accordingly, the invention is not to be limited to the precise embodiment shown and described, but only as indicated in the following claims.

EXAMPLE 1

Cow blood stains on cotton and wool were dry cleaned according to the invention. At the middle of 8.75"×4.75" cloths, a 2" diameter circle was inscribed with a pencil. 300 microliters of cow blood, which was used as received from a butcher's shop, were applied using a micropipet to the inside of the circles and spread to the edges of the circle or each cloth. The cloths were then dried overnight. Four replicates of the stained cloth for each cloth type were used for the experiments and subsequent readings. The cloths were placed in the cleaning chamber of a $CO_2$ dry cleaning unit purchased from Alliance Laundry Systems. To simulate a full load of clothes, 20 pounds of cotton ballast sheets (15"×15") were also placed in the cleaning chamber. The dry cleaning unit used circulated a total volume of about 267 liters of liquid $CO_2$ in the cleaning loop. There was also a storage tank on the unit from which the fresh liquid $CO_2$ was added once the chamber door was closed and sealed. The cleaning cycle lasted for 12 minutes at about 750 psi and 11 degrees Celsius. After the cleaning cycle, the liquid $CO_2$ in the cleaning loop was pumped back into the storage tank, and the chamber door opened.

To measure the extent of cleaning, spetrophotometric readings were taken of the cloths using a Hunter Ultrascan XE spectrophotometer. The R scale, which measures darkness from black to white, was used to determine stain removal. Cleaning results were reported as ,he percent stain removal according to the following calculation.

$$\%\ \text{stain removal} = \frac{\text{stain removed}}{\text{stain applied}} = \frac{\text{cleaned cloth reading} - \text{stained cloth reading}}{\text{unstained cloth reading} - \text{stained cloth reading}} \times 100\%$$

For the cleaning experiment in liquid $CO_2$, 133.5 g (0.05% weight/volume based on 100% active) of Triton CG 110 (an alkyl glycoside surfactant available from Union Carbide), 267.0 g (0.10% weight/volume) of water, and 66.75 g (0.025% weight/volume) of propylene glycol were used. Surfactant, water and propylene glycol were premixed and added directly to the bottom of the cleaning chamber below the ballast and not on the stains themselves. After the wash cycle, and removal of $CO_2$ from the cleaning chamber, cleaning results were evaluated, and are reported in Table 1 below.

TABLE 1

Dry Cleaning Results on Cow Blood Stains Using Liquid Carbon Dioxide and Surfactant Comprising a Carbohydrate Group

| Surfactant | Cloth | % Stain Removal |
|---|---|---|
| None | cotton | 8.6 |
| 0.05% Triton CG 110 | cotton | 21.3 |
| None | wool | 22.7 |
| 0.05% Triton CG 110 | wool | 45.9 |

These results demonstrate that there is a dramatic increase in cleaning when a surfactant comprising a carbohydrate group is used.

EXAMPLE 2

Make-up stains on cotton and silk were dry cleaned in liquid $CO_2$ under the conditions described in Example 1. The center of cloths (cloths 8.75"×4.75") had a 2" diametercircle inscribed with a pencil. The stained cloths were prepared from store purchased Revlon Touch and Glow, mineral oil based make-up (color: Rachel). On cotton, 250 microliters of make-up used as purchased were applied to the cloth and spread within the 2 in. circle using a spatula until evenly distributed. The same procedure was used for the silk cloths, except 275 microliters of make-up was used. For this cleaning experiment, 133.5 g (0.05% weight/volume based on 100% active) of Triton CG 110 (an alkyl glycoside surfactant available from Union Carbide), 267.0 g (0.10% weight/volume) of water, and 66.75 g (0.025% weight/volume) of propylene glycol were used. Cleaning results are reported in Table 2.

TABLE 2

Dry Cleaning Results on Make Up Stains Using Liquid Carbon Dioxide and Surfactant Comprising a Carbohydrate Group

| Surfactant | Cloth | % Stain Removal |
|---|---|---|
| None | cotton | 26.9 |
| 0.05% Triton CG 110 | cotton | 38.5 |
| None | silk | 32.6 |
| 0.05% Triton CG 110 | silk | 60.7 |

These results demonstrate that there is a dramatic increase in cleaning when a surfactant comprising a carbohydrate group is used.

What is claimed is:

1. A dry cleaning system comprising a surfactant comprising a hydrocarbon group which is solvent-philic and a carbohydrate group which is less solvent-philic than the hydrocarbon group wherein the dry cleaning system further comprises a continuous phase solvent which is a biodegradable hydrocarbon or a silicon comprising solvent.

2. The dry cleaning system according to claim 1 wherein the surfactant has the formula:

AXB and (i) A is a moiety which is more soluble in the dry cleaning solvent than B;

X is

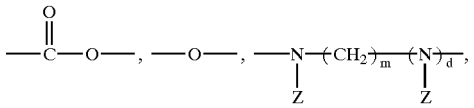

a divalent group comprising P or

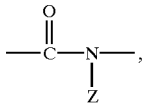

(iii) B is a carborydrate group;

(iv) Z is H, or a $C_{1-10}$ alkyl group, or

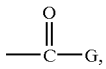

and G is a $C_{1-6}$ alkyl, (v) m is an integer from 0 to about 10, and d is 0 when m is 0 and 1 when m is $\geqq 1$, with the proviso that A is not a siloxane, a halocarbon, or a polyalkylene oxide.

3. The dry cleaning system according to claim 2 wherein the surfactant is a biosurfactant or microbial surfactant.

4. The dry cleaning system according to claim 2 wherein the surfactant is a dimeric or trimeric surfactant produced from surfactants having the formula AXB.

5. The dry cleaning system according to claim 2 wherein A is a $C_3$ to $C_{15}$ alkyl group or an aryl group and B is a carbohydrate group selected from the group consisting of glucose, fructose, sucrose, galactose, lactose, ribose, lyose, allose, altrose, erythrose, talose, mannose, a derivative thereof, and a disaccharide prepared therefrom.

6. The dry cleaning system according to claim 5 wherein A is a $C_8$ to $C_{10}$ alkyl group, X is

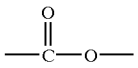

and is a glucose group.

7. The dry cleaning system according to claim 1 wherein the surfactant has an HLB of less than 13.

8. A method for dry cleaning fabric comprising the steps of:

(a) contacting the fabric with a continuous phase solvent which is a biodegradable hydrocarbon or a silicon comprising solvent; and (b) contacting the fabric with a surfactant comprising a hydrocarbon group which is solvent-philic and a carbohydrate group which is less solvent-philic than the hydrocarbon group.

9. The method for dry cleaning a fabric according to claim 8 wherein the method further comprises the step of contacting the fabric with a polar additive.

10. The method for dry cleaning a fabric according to claim 9 in wherein the polar additive is water, and a reverse micelle is formed.

11. The method for dry cleaning a fabric according to claim 8 wherein the continuous phase solvent is a siloxane.

12. The method for dry cleaning a fabric according to claim 8 wherein the surfactant has the formula:

AXB and (i) A is a moiety which is more soluble in the dry cleaning solvent than B;

(ii) X is

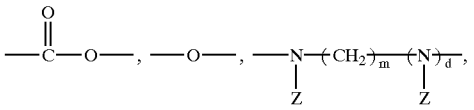

a divalent group comprising P, or

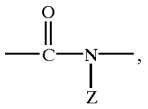

(iii) B is a carbohydrate group;

(iv) Z is H, or a $C_{10-10}$ alkyl group, or

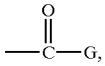

and G is a $C_{1-6}$ alkyl, (v) is an integer from 0 to about 10, and d is 0 when m is 0 and 1 when m is $\geqq 1$, with the proviso that A is not a siloxane, a halocarbon, or a polyalkylene oxide.

13. The method for dry cleaning a fabric according to claim 12 wherein the surfactant is a biosurfactant or microbial surfactant.

14. The method for dry cleaning a fabric according to claim 12 wherein the surfactant is a dimeric or trimeric surfactant produced from surfactants having the formula AXB.

15. The method for dry cleaning a fabric according to claim 12 wherein A is a $C_3$ to $C_{15}$ alkyl group or an aryl group and B is a carbohydrate group selected from the group consisting of glucose, fructose, sucrose, galactose, lactose, ribose, lyxose, allose, altrose, erythrose, talose, mannose, derivatives thereof, and a disaccharide prepared therefrom.

16. The method for dry cleaning a fabric according to claim 15 wherein A is a $C_8$ to $C_{10}$ alkyl group, X is

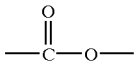

and B is a glucose group.

17. The method for dry cleaning a fabric according to claim 8 wherein the surfactant has an HLB of less than 13.

18. The method for dry cleaning a fabric according to claim 8 wherein the method is conducted in a dry cleaning washing machine pressurized from about 14.7 to about 10,000 psi and set at a cleaning temperature from about −30.0° C. to about 100° C.

* * * * *